US006179283B1

(12) United States Patent
Gerstenberg et al.

(10) Patent No.: US 6,179,283 B1
(45) Date of Patent: Jan. 30, 2001

(54) METHOD FOR CONTROLLING AN INTERMEDIATE STACKING DEVICE FOR FLAT SHIPMENTS

(75) Inventors: Frank Gerstenberg, Berlin; Holger Schererz, Rehfelde; Gerhard Obier, Berlin; Joachim Kuehnapfel, Constance, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/143,374

(22) Filed: Aug. 28, 1998

(30) Foreign Application Priority Data

Aug. 29, 1997 (DE) ..... 197 37 857

(51) Int. Cl.[7] ..... B65H 1/02

(52) U.S. Cl. ..... 271/150; 271/152; 271/154; 271/157; 271/162; 271/3.01; 271/3.12; 271/3.13

(58) Field of Search ..... 271/150, 152, 271/157, 154, 162, 3.01, 3.12, 3.13

(56) References Cited

FOREIGN PATENT DOCUMENTS

483480B * 2/1975 (AU) .
1235818 * 3/1967 (DE) .
195 47 292 A1 * 6/1997 (DE) .

* cited by examiner

*Primary Examiner*—Donald P. Walsh
*Assistant Examiner*—Jonathan R Miller
(74) *Attorney, Agent, or Firm*—Venable; Norman N. Kunitz

(57) ABSTRACT

A method for controlling an intermediate stacking device for flat shipments, in particular in letter sorting facilities, comprising a stacking device (SR) on a movable stacking cart (SW), a bottom transporting belt (UB) on which the shipments are positioned crosswise to the belt movement direction, and a separating device with a withdrawal means (AR), as well as a shipment sensor (FH2), which detects the shipments at the separating device. In order to correct without problems a slanted position of the shipment stack at the separating device, the normal operational control of the intermediate stacking device becomes invalid if a predetermined time interval during which no shipments are detected at the withdrawal means (AR) is exceeded, the supply of shipments to the intermediate stacking device is interrupted, the bottom transporting belt (UB) is stopped, and the stacking cart (SW) is put into motion in the direction of the separating device. If a shipment is once more detected at the withdrawal means and taking into account a preferably linearly dependent lag time that depends on the measured filling level of the intermediate stacking device, the compression movement of the stacking cart (SW) is stopped, the supply of shipments to the intermediate stacking device is resumed again and the drives for bottom transporting belt (UB) and stacking cart (SW) are again controlled in the normal operation.

6 Claims, 2 Drawing Sheets

METHOD FOR CONTROLLING AN INTERMEDIATE STACKING DEVICE FOR FLAT SHIPMENTS

BACKGROUND OF THE INVENTION

The invention relates to a method for controlling an intermediate stacking device of flat shipments, in particular in letter sorting facilities, which comprises a stacking device positioned on a movable stacking cart, a bottom transport belt on which the shipments are positioned crosswise to the belt movement direction, and a separating device having a withdrawal means as well as a shipment sensor for detecting the shipments at the separating device.

Intermediate stacking devices are used, for example, in letter sorting facilities to connect different structural components. The intermediate stacking device in this case buffers the irregularly arriving shipments, so that the following structural components are stressed relatively evenly.

The DE-AS 12 35 818 discloses a device for stacking shipments, in particular postal shipments, with the aid of a stacking roller, arranged on a stacking cart. The device furthermore comprises a bottom transporting belt, a separating device, spring-mounted elements for stopping the shipments at the stacking wall and to prevent a rebounding from the stacking wall, as well as a switch that controls the forward and backward movements of the stacking cart in dependence on the pressure exerted by the stack leaning against it.

In a known intermediate stacking device, the individual shipments to be stacked, which are clamped between a front belt and a rear belt, are conveyed close to the stacking location where a stack of shipments already exists or is being formed with the shipments to be stacked. The stack is formed by conveying the shipments individually, one after another, with their front edge to a stacking wall. For this, the front belt is removed from the shipment at a certain distance from the stacking wall. Owing to its mass moment of inertia, the shipment continues to move along a guide rail in the direction of the stacking wall. Finally, the shipment is conveyed by the rotating stacking roller into the space between the shipment stack and the stacking roller and is conveyed further until it reaches the stacking wall.

The shipments in the shipment stack are positioned with their lower edges on a bottom transport belt, crosswise to its movement direction, which belt can be moved along the stacking wall. A separating device is provided on the stack side opposite the stacking roller, which can withdraw the shipments one after another from the stack of shipments for further processing.

The bottom transport belt is moved in the direction of the separating device such that the stack leans against the separating device, and the shipment closest to the separating device can be withdrawn. In the stacking region, the stacking roller must be positioned such that the shipments to be stacked can be conveyed without problems between the stacking roller and the stack to the stacking wall. A device for measuring the stack pressure is provided for this near the stacking roller, and a device for detecting possible slanted positions of the shipment stack is provided at the stacking location. The stacking cart is moved along the bottom transport belt until the shipment stack exerts a specific pressure upon the pressure measuring device, provided the device does not signal a slanted position. If a slanted position has been detected at the stacking location, the stacking cart and/or the bottom transport belt are moved until the slanted position has been corrected.

The "migration" of the stack from the stacking location to the withdrawal location is made possible by the bottom transport belt on which the stack rests. Inside the withdrawal device, this bottom transport belt is controlled by sensing levers functioning as shipment sensors. If these sensing levers are disengaged, meaning if they signal that no shipment is present at the withdrawal means for the separating device, then the complete stack is moved forward by means of the bottom transport belt until the sensing levers are no longer disengaged.

The use of a friction/suction separating device according to the DE-PS 43 13 150 has the advantage of providing a better withdrawal gap stability, as long as the shipment stack rests solidly against the withdrawal means. However, by suctioning in the shipment that is respectively in front, the sensing levers are depressed even if the stack behind it has already become loose. Thus, this situation cannot be detected by means of the standard bottom-transport belt controls, and the stack cannot be made to follow continuously. As a result, the stack loosens even further and becomes slanted until the suction pressure is no longer sufficient to withdraw the shipment in front. Depending on the condition of the shipment, the subsequent bottom transport belt movement in most cases cannot correct the slanted position. In the final effect, the gaps increase and the throughput decreases.

It is thus the object of the invention to create a method for intermediate stacking devices of the type originally described, which method is designed to correct the slanted positions of the shipment stack at the separating device without causing any disturbance and without requiring additional devices.

The method includes a limit value for the time interval during which no shipment is present at the withdrawal means, which interval is the starting point for detecting a slanted stack position. The duration of the stack compression depends on the stack thickness. This is designed to avoid the effect that if the stack is compressed for too short a time, the compressing has no effect and if the stack is compressed for too long a time, the shipments or machines will be damaged.

Advantageous embodiments and modification of the invention are described and claimed.

The invention is explained further below with an embodiment and with the aid of the drawing.

PREFERRED EMBODIMENT

Figure 1:
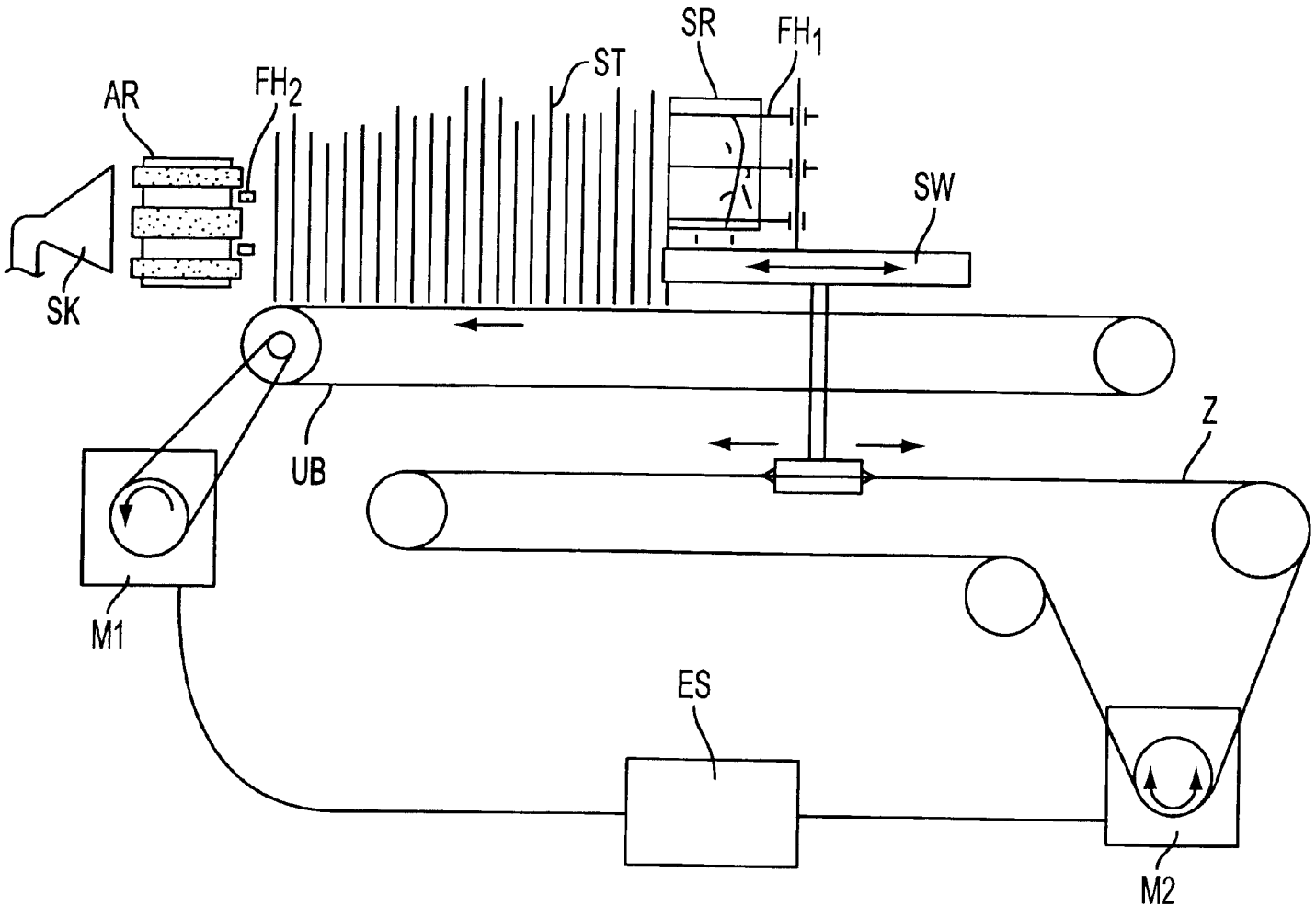
FIG. 1 is a basic illustration of an intermediate stacking device, controlled in accordance with the invention.
Figure 2:
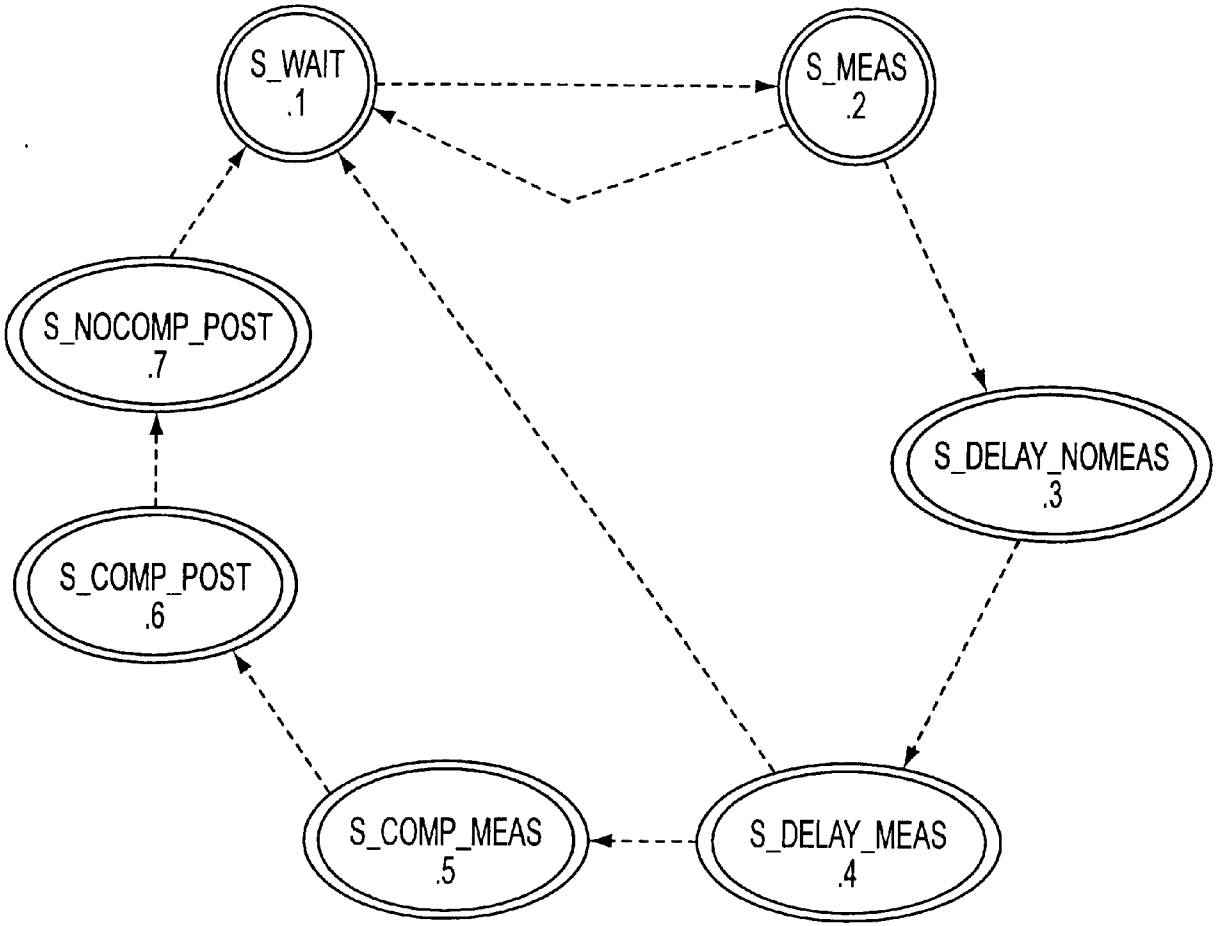
FIG. 2 is a status diagram of the sequence of steps carried out during the process and corresponds to the possible state transitions shown in the last column of diagram 1.

Shipments are supplied to the intermediate stacking device by an immediately preceding structural component, e.g. a format separating device. The format separating device separates the shipments on the basis of their formats (thickness, width, height) into shipments that can be handled by a machine and shipments that cannot be handled by a machine.

Shipments handled by a machine are moved to a stacking roller SR, which is positioned on a movable stacking cart SW, driven by a motor M2 via a toothed belt Z, and are stacked by this stacking roller SR to form the shipment stack ST, which rests on a movable bottom transport belt UB, driven by an additional motor M1. The stack pressure as well as a slanted position of the stack are measured at the stacking location by means of special sensing levers FH1, and the measured values are transmitted to a control unit ES, which moves the stacking cart SW and the bottom transport belt UB at the stacking location, depending on the stack pressure that must be maintained and the slanted position of stack ST that must be compensated.

A sensing lever FH2 as shipment sensor is also provided at the separating device, which comprises the withdrawal belt AR and the suction chamber SK as withdrawal means. This shipment sensor detects the presence of shipments at the withdrawal roller.

A slanted position of the shipment stack ST is detected at the withdrawal location if a limit value for the time interval is exceeded during which the sensing lever FH2 is in the disengaged state. Following this, the hitherto existing automatic control is discontinued, the bottom transport belt UB is stopped and the stacking cart SW is put into motion in the direction of the separating device. Since the shipment stack must be compressed more to maintain a specific stack pressure if a stack consists of thick shipments ST than if the stack consists of thin shipments, the compression operation ends only after the filling lever FH2 is depressed once more and following an additional lag time that depends on the filling level.

Since the automatic control of the stacking behavior is rendered ineffective during the forward movement of the stacking cart SW, the stacking during the stack compression must be stopped with the aid of the immediately preceding format separating device. The therewith connected performance loss for the format separating device is unimportant if the intermediate stacking device filling level is in the upper range and the withdrawal gaps for the intermediate stacking device are already larger due to the slanted stack position. A hardware (HW) signal was transmitted for this to the format separating device. Once put into operation, the format separating device guides the shipments, pulled off by the singulator, to a holding loop. In accordance with the invention, this signal is controlled by taking into account a correction value.

Outside of the compression operation, the bottom transport belt UB is linked only to the sensing lever FH2 of the separating device, meaning the belt operates as soon as the sensing lever is disengaged. It must be stopped during the compression operation to force a tilting forward of the stack front, which is for the most part slanted back with the upper edges of the shipments.

This method was realized as state automaton via the control. This automaton decides on the start and the end of the compression operation by evaluating the above-named criteria. Depending on the individual states, the following signals are controlled:

StackCarGo (forward movement of the stacking cart SW through bypassing of the automatic stacking control);

BottomTrBelt (forward movement of the bottom transport belt UB)

StackingDisable (deflection of shipments from the format separating device to the holding loop).

In addition to this state automaton, a compression crash monitoring was realized, which detects whether a compression lasts too long, then ends the compression operation prematurely, independent of the state, and thus protects the postal good and the machine.

States and Transitions between States

| state | content | possible state transitions |
|---|---|---|
| S_WAIT | waiting until the sensing lever FH2 is identified as disengaged | - -> S_MEAS |
| S_MEAS | measuring the time interval during which the sensing lever FH2 is disengaged, comparing this to time limit value ("StCompTimeMeas") | if (time limit value is exceeded) - -> S_DELAY_NOMEAS if (sensing lever was depressed once more before that) - -> S_WAIT |
| S_DELAY_NOMEAS | stopping the stacking without evalution of the sensing lever FH2 measuring the time and comparing to limit value ("StCompTimeDelay Nomeas") | if (time limit value is exceeded) - -> S_DELAY_MEAS |
| S_DELAY_MEAS | stopping the stacking with evaluation of sensing lever FH2 measuring of time and comparison with limit value ("StCompTimeDelay Meas") | if (time limit is exceeded) - -> S_COMP_MEAS if (sensing lever is pushed again first) - -> S_WAIT |
| S_COMP_MEAS | compressing of the stack; evaluating of sensing lever FH2 to determine the state transition; measuring of time to calculate the point in time for going ahead with the stacking | if (sensing lever is depressed again) - -> S_COMP_POST |
| S_COMP_POST | compressing of the stack; measuring of the time and comparing it to a filling-level dependent limit value ("StCompTimePost") | if (time limit value is exceeded) - -> S_NOCOMP_POST |
| S_NOCOMP_POST | no compressing; normal control becomes effective once more, measuring of time and comparing it to a filling-level dependent limit value ("StNoCompTimePost") | if (time limit value is exceeded) - -> S_DELAY_WAIT |

Detailed explanations to the individual states:

S—MEAS

An excessively loose stack is identified only if the filling lever FH2 has been disengaged for a time interval exceeding a limit value. Optimizing task: If this limit value is set:

too high, the stack becomes excessively loose;

too low, the format separating device is slowed down too often owing to stops in the stacking operation.

S—DELAY NOMEAS, S DELAY_MEAS

The compression operation starts with the stop in the stacking operation at the format separating device. During the interval required for stacking the remaining shipments (it is composed of a fixed and a filling-level dependent share), the normal stacking cart SW control is active. In rare cases, this normal control can meanwhile also effect the desired setting up again. In that case, the compression operation must be stopped (danger of crash with solid stack). Since a check for this case does not make sense until all the remaining shipments have been stacked, the operation was divided into the states S_DELAY—NOMEAS and S—DELAY—MEAS.

S—COMP—MEAS

As long as the sensing lever FH2 is not engaged, there is no time limit on the compressing operation.

S_COMP—POST

This is the actually effective and simultaneously the most critical phase of the compression operation. With the exception of the filling level, mentioned below for the crash monitoring, a signal is no longer available for detecting the solidity of the stack. The lag therefore is exclusively time-controlled, wherein the time is calculated from a fixed and a filling-level dependent share.

S_NOCOMP—POST

The unregulated forward movement of the stacking cart SW is ended; the normal control becomes effective again; the stack pressure at the stacking location (not in the total stack) relaxes to normal pressure conditions. Following a fixed time interval ("StNoCompTimePost"), shipments can be stacked once more.

Output signal level in the individual states

| state | StackCarGo | bottom transport belt | stacking disable |
|---|---|---|---|
| S_WAIT | OFF | OFF | OFF |
| S_MEAS | OFF | ON | OFF |
| S_DELAY_NOMEAS | OFF | OFF | ON |
| S_DELAY_MEAS | OFF | OFF | ON |
| S_COMP_MEAS | ON | OFF | ON |
| S_COMP_POST | ON | OFF | *) see below |
| S_NOCOMP_POST | ON | *) see below | *) see below |

*) The transitions between the states S_COMP_POST - -> S_NOCOMP_POST and S_NOCOMP_POST - -> S_WAIT no longer depend on an expected input signal level, but only on the calculated lag times. Thus, the point in time at which the normal control for the stacking cart SW again permits the stacking of shipments is know in the state S_COMP_POST. Depending on the filling level, the signal StackingDisable can be #
withdrawn again in the states S_COMP_POST and S_NOCOMP_POST, if the remaining time for the compression operation until normal pressure conditions have been restored at The transitions between the states S_COMP_POST_>S_NOCOMP_POST and S_NOCOMP_POST_>S_WAIT no longer depend on an expected input signal level, but only on the calculated lag times. Thus, the point in time at which the normal control for the stacking cart SW again permits the stacking of shipments is known in the state S_COMP_POST. Depending on the filling level, the signal StackingDisable can be withdrawn again in the states S_COMP_POST and S_NOCOMP_POST, if the remaining time for the compression operation until normal pressure conditions have been restored at the stacking location is shorter or equal to the time interval required for the shipments to travel from the holding loop diverter to the stacking point at the intermediate stacking device. Depending on the filling level, this can occur immediately after the entry into S_COMP_POST, or not until shortly thereafter when the mentioned time intervals are equal. The interruption in the supply of shipments is thus kept to a minimum.

In the S_NOCOMP_POST state, the bottom transport belt is switched back to normal, meaning ON if the sensing lever FH2 is disengaged and OFF if the sensing lever FH2 is depressed. The complete compression operation takes place within one task, controlled by the belt cycle. For that reason, all above-mentioned time measurements and time calculations are carried out within this time grid.

The four time limit values, relevant to the state transitions, were mentioned previously in the table "States and State Transitions." Two of these values are fixed:

StCompTimeMeas

StCompTimeDelayMeas; the other two values are calculated for the operating time since they include the stack filling level "Filling" (in %) as a variable, as well as three other fixed values and the previously mentioned StCompTimeDelayMeas:

StCompTimeDelayNomeas=StCompTimeDelay+(100−filling)−StCompTimeDelayMeas

StCompTimeCompPost=StCompTimeCompPostFix+StCompTimeCompPostVar (filling)

The three additional fixed values are:

StCompTimeDelay

StCompTimeCompPostFix

StCompTimeCompPostVar

During the compression operation, an extremely sensitive monitoring of the stacking cart speed is used to detect whether the stacking cart SW is stopped by impacting with an obstruction (excessively compressed stack of shipments). If that is the case, the compression operation is stopped immediately. This crash monitoring is an additional protective measure, which is not intended to respond under normal circumstances.

What is claimed is:

1. A method for controlling an intermediate stacking device of flat shipments, in particular in letter sorting facilities, which comprises a stacking device (SR), positioned on a movable stacking cart (SW), a bottom transport belt (UB) on which the shipments are positioned crosswise to the belt movement direction, and a separating device having a withdrawal means (AR, SK) as well as a shipment sensor (FH2) for detecting the shipments at the separating device, and wherein: if a predetermined time interval during which no shipments are detected at the withdrawal means (AR, SK) is exceeded, normal operations control at the intermediate stacking device becomes invalid, the supply of shipments to the intermediate stacking device is interrupted, the bottom transport belt (UB) is stopped, the stacking cart (SW) is put in motion in the direction of the separating device, and if a shipment is once more detected at the withdrawal means and taking into account a lag time that depends on a measured filling level of the intermediate stack, compression movement of the stacking cart (SW) is stopped, the supply of shipments to the intermediate stacking device is resumed and the drives for the bottom transport belt (UB) and the stacking cart (SW) are once more controlled, such that they operate normally.

2. A method according to claim 1, wherein the lag time for the stacking cart (SW) is linearly dependent on the measured filling level of the intermediate stacking device.

3. A method according to claim 1, wherein shipments are once more supplied to the intermediate stacking device if the remaining time interval for the compression operation until normal pressure conditions have been restored at the stacking location is shorter or equal to the time required for the shipments, which are temporarily stored by the preceding structural component, to reach the stacking point at the intermediate stacking device.

4. A method according to claims 1, wherein if the braking acceleration of the stacking cart (SW) during the compression phase is too high, the compression operation is stopped.

5. A method according to claim 1, wherein the shipments are separated with the aid of suction air.

6. A method according to claim 1, wherein during normal operations and provided no shipment is present at the separating device, the bottom transporting belt (UB) is moved in the direction of the separating device until a shipment is detected once more at the withdrawal means and the stacking cart (SW) as well as the bottom transporting belt (UB) are moved in such a way that a specific stack pressure range is maintained at the stacking location and a slanted position of the shipment stack (ST) is avoided at the stacking location.

* * * * *